US008839719B2

(12) United States Patent
Badoux

(10) Patent No.: US 8,839,719 B2
(45) Date of Patent: Sep. 23, 2014

(54) FOIL GUIDING DEVICE FOR STAMPING MACHINE

(75) Inventor: Frédéric Badoux, Shanghai (CN)

(73) Assignee: Bobst Mex SA (CH)

( * ) Notice: Subject to any disclaimer, the term of this patent is extended or adjusted under 35 U.S.C. 154(b) by 29 days.

(21) Appl. No.: 13/822,760

(22) PCT Filed: Aug. 31, 2011

(86) PCT No.: PCT/EP2011/004381

§ 371 (c)(1),
(2), (4) Date: Mar. 13, 2013

(87) PCT Pub. No.: WO2012/034649

PCT Pub. Date: Mar. 22, 2012

(65) Prior Publication Data

US 2013/0174752 A1 Jul. 11, 2013

(30) Foreign Application Priority Data

Sep. 16, 2010 (EP) ..... 10009666

(51) Int. Cl.
*B44B 5/00* (2006.01)
*B41F 16/00* (2006.01)
*B41F 19/00* (2006.01)

(52) U.S. Cl.
CPC ..... *B41F 16/006* (2013.01); *B41F 19/005* (2013.01); *B41F 16/0046* (2013.01)
USPC ..... 101/480; 101/18; 101/22; 101/32; 101/483

(58) Field of Classification Search
CPC ..... B44B 5/00
USPC ..... 101/480
See application file for complete search history.

(56) References Cited

U.S. PATENT DOCUMENTS

| | | | | |
|---|---|---|---|---|
| 1,630,905 | A * | 5/1927 | Reeve | 101/173 |
| 2,783,175 | A * | 2/1957 | Smith et al. | 101/32 |
| 5,134,931 | A * | 8/1992 | Thompson et al. | 101/27 |
| 5,611,272 | A * | 3/1997 | Steuer | 101/25 |
| 6,892,633 | B2 * | 5/2005 | Both et al. | 101/32 |
| 7,424,903 | B2 * | 9/2008 | Kagi et al. | 156/459 |

FOREIGN PATENT DOCUMENTS

| | | |
|---|---|---|
| EP | 1 468 828 A2 | 10/2004 |
| EP | 1 593 503 A2 | 11/2005 |

OTHER PUBLICATIONS

International Search Report dated Oct. 28, 2011 issued in corresponding International application No. PCT/EP2011/004381.

* cited by examiner

*Primary Examiner* — Jill Culler
(74) *Attorney, Agent, or Firm* — Ostrolenk Faber LLP

(57) ABSTRACT

A guiding device 10 for guiding at least one stamping foil 410 at the inlet to a platen press 310. The guiding device 10 includes a diverting member 20 which is mounted with the ability to move between a work position in which the diverting member 20 is able to direct each stamping foil 410 into the platen press 310 in a given feed plane, and a maintenance position in which the diverting member 20 is placed in a space directly accessible to a user.

18 Claims, 3 Drawing Sheets

FOIL GUIDING DEVICE FOR STAMPING MACHINE

CROSS-REFERENCE TO RELATED APPLICATIONS

The present application is a 35 U.S.C. 517 §371 national phase conversion of PCT/EP2011/004381, filed Aug. 31, 2011, which claims priority of European Application No. 10009666.8, filed Sep. 16, 2010, the contents of which are incorporated by reference herein. The PCT International Application was published in the French language.

BACKGROUND OF THE INVENTION

The present invention relates to a device for guiding the feed of one or more stamping foils as they enter a platen press.

The invention finds a particularly advantageous application in the field of stamping machines.

It is known practice for texts and/or patterns to be printed by stamping, that is by using pressure to apply colored or metalized film taken from one or more stamping foils, commonly known as metalized foils to a medium in sheet form. In the relevant industry, such a transfer operation is usually performed using a vertical platen press into which the print supports are introduced, sheet by sheet, while the stamping foils are fed continuously.

In a standard platen press, stamping is performed between a fixed platen extending horizontally and a platen mounted to move in a reciprocating vertical movement. Because this type of press is generally automated, conveyer means are provided to bring one sheet at a time between the platens. In practice, the conveyor means usually comprises a series of gripper bars, each of which in turn grasps a sheet at its leading or front edge, before then pulling the sheet between the two platens of the press when the platens have been parted sufficiently.

A stamping foil is itself comprised of a backing foil of polyester type, to which a pigmented layer is secured by a layer of wax. The external face of the pigmented layer is coated with a coat of hot-melt adhesive. Like feeding of the sheets, the feeding of stamping foils to the press is conventionally automated, by a drive system capable of unwinding each of the foils and feeding it along a clearly determined feed path which notably passes through the platen press. In general, such a foil feed system combines a series of diverting bars, which are installed along the entire feed path to guide the progress of the foils, with a number of advance shafts which are positioned downstream of the feed path in order respectively to drive the movement of each of the foils.

In practice, because the feed path of the stamping foils passes through the platen press, a diverting bar is often present in direct proximity to the entrance to the press. Because the position at which that bar is installed governs the passage of the foils between the platens, that bar is usually rigidly secured to a fixed part of the press, generally the upper platen.

This type and placement of a diverting bar does, however, have the disadvantage of being particularly exposed to soiling, while at the same time being intrinsically difficult to access. It therefore proves to be extremely difficult to clean it or perform mechanical interventions on it.

The soiling particularly concerns the metalized or colored particles, particles of adhesive, and also surrounding dust. The diverting bar is intended to be in permanent contact with the stamping foils which have colored or metalized film on one side and adhesive on the other. The diverting bar therefore logically has a tendency to become soiled rapidly.

The lack of accessibility of the diverting bar is essentially due to its being installed in direct proximity to the entry to the platen press, which is a particularly cluttered region of the stamping machine. In this region, it is common to find a locking system of the chassis which supports certain tools of the platen press, a locking system of the gripper bars, a fly, and particularly bulky elements of the gripper bar drive system.

Hence, the technical problem which the present invention attempts to solve is proposing a device for guiding at least one stamping foil at the entrance to a platen press, which device makes it possible to avoid the problems of the prior art by offering substantially better ease of maintenance.

SUMMARY OF THE INVENTION

The solution to the above stated technical problem comprises the guiding device comprising a diverting member which is mounted to move between a work position in which the diverting member is able to direct each stamping foil into the platen press in a given feed plane, known as the operational plane and a maintenance position in which the diverting member is placed in a space directly accessible to a user.

That work position according to the invention corresponds to the fixed position in which the diverting members of the prior art are installed. The maintenance position is a new operating position which, in theory, could be situated in any free space of the machine, which space is substantially easier to access than the space devoted to the work position.

The operational plane is the plane in which each stamping foil is supposed to be fed when the platen press is in its normal mode of operation, as in FIG. 3 hereof.

The invention provides good convenience of access to the diverting member. Mobility of the diverting member enables it to be moved into an easily accessible region of the machine. This makes it particularly easy to carry out a cleaning operation or some arbitrary mechanical intervention.

The present invention also relates to the features described herein, and which may be considered separably or in any technically feasible combination.

BRIEF DESCRIPTION OF THE DRAWINGS

The description below refers to the attached drawings, in which.

DESCRIPTION OF AN EMBODIMENT OF THE INVENTION

For clarity, the same elements have been denoted by identical references. Likewise, only elements for understanding the invention have been depicted, schematically and not to scale.

Figure 1:
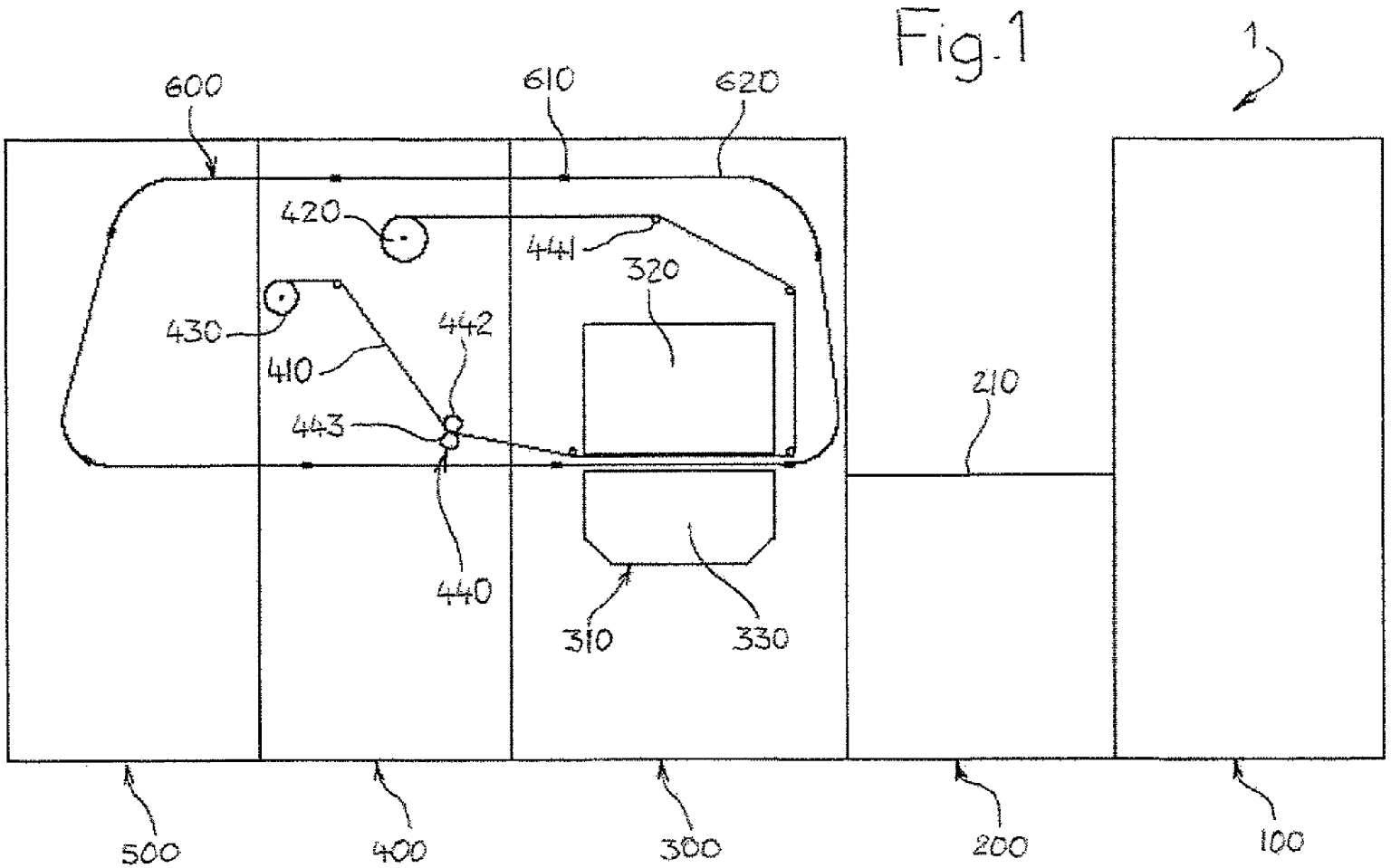
FIG. 1 schematically illustrates a printing machine incorporating a stamping station fitted with a foil guiding device according to the invention.

FIG. 1 depicts as an example a stamping machine 1 which is intended for customizing cardboard packaging, e.g. for the luxury goods industry. This may be commonly known as a gilding machine. This stamping machine 1 is conventionally made up of a number of work stations 100, 200, 300, 400, 500 in sequence which are juxtaposed with an interdependent on one another to form a unitary assembly capable of processing a series of supports in sheet form. Thus stations include a feeder 100, a feed table 200, a stamping station 300, a foil feed and recovery station 400, and a delivery station 500. A conveyer device 600 individually moves each sheet from the exit of the feed table 200 to the delivery station 500, including moving it through the stamping station 300.

The various parts 100, 200, 300, 400, 500, 600 of the printing machine 1 are known from prior art and are not described in detail here, in their structure or their operation.

In this embodiment, shown for example, the feeder 100 is fed via a succession of pallets on each stacked with a plurality of sheets of cardboard. Each sheet is successively taken off the top of the stack by a suction-type gripper member which transports the sheet as far as the directly adjacent following feed table 200.

At the feed table 200, each sheets is laid out in a layer by the suction-type gripper member, so that the sheets are laid out one after another with partial overlap, i.e. they are shingled. The whole layer is then driven along a platform 210 toward the stamping station 300, by means of a belt-type conveyer mechanism. At the end of that layer, the then lead sheet is systematically positioned accurately using front and side lays.

The work station situated just after the feed table 200 is the stamping station 300 hereof which applies to each sheet, by hot stamping, some metallized film which comes from a single stamping foil 410 in this embodiment. The stamping uses a platen press 310 in which performs the stamping operation in a conventional way, between a heated upper platen 320, which is fixed, and a lower platen 330 which is mounted to move in a reciprocating vertical movement.

Downstream of the stamping station 300 is the foil feed and recovery station 400. This station has a dual role of both feeding the machine with stamping foil 410, and of removing this foil once it is spent.

In this embodiment, the foil 410 is stored conventionally in wound form around a feed reel 420 mounted to rotate. After it passes through the platen press 310, the foil 410 is wound up around a take-up reel 430 mounted to rotate.

Between its storage and take-up points, the foil 410 is driven to advance by a drive system 440 which is capable of advancing it over a given distance and along a determined feed path which passes through the platen press 310. This foil drive system 440 primarily comprises a series of diverting bars 441, which are installed across the feed path at intervals along the feed path at locations to guide the movement of the foil 410 and comprises a combination of a advancing shaft 442 and of a press roller 443 which are positioned downstream of said feed path in order to drive advancing of the foil 410 along.

Processing of the sheets in the printing machine 1 ends in the delivery station 500. Its main function is to reform the already processed sheets back into a stack. The conveyer device 600 is arranged to automatically release each sheet when the sheet is vertically aligned with the new stack. The sheet is there dropped squarely onto the top of the stack.

In a conventional way, the conveyer device 600 comprises a series of gripper bars 610 which are mounted at spaced intervals along the path and each having transverse translational mobility. The mounting by two chain sets 620 which are arranged laterally, along each side of the stamping machine 1. Each chain set 620 travels in a loop which directs the gripper bars 610 to follow a trajectory that passes in succession through the stamping station 300, the feed and removal station 400 and the delivery station 500.

Figure 2:
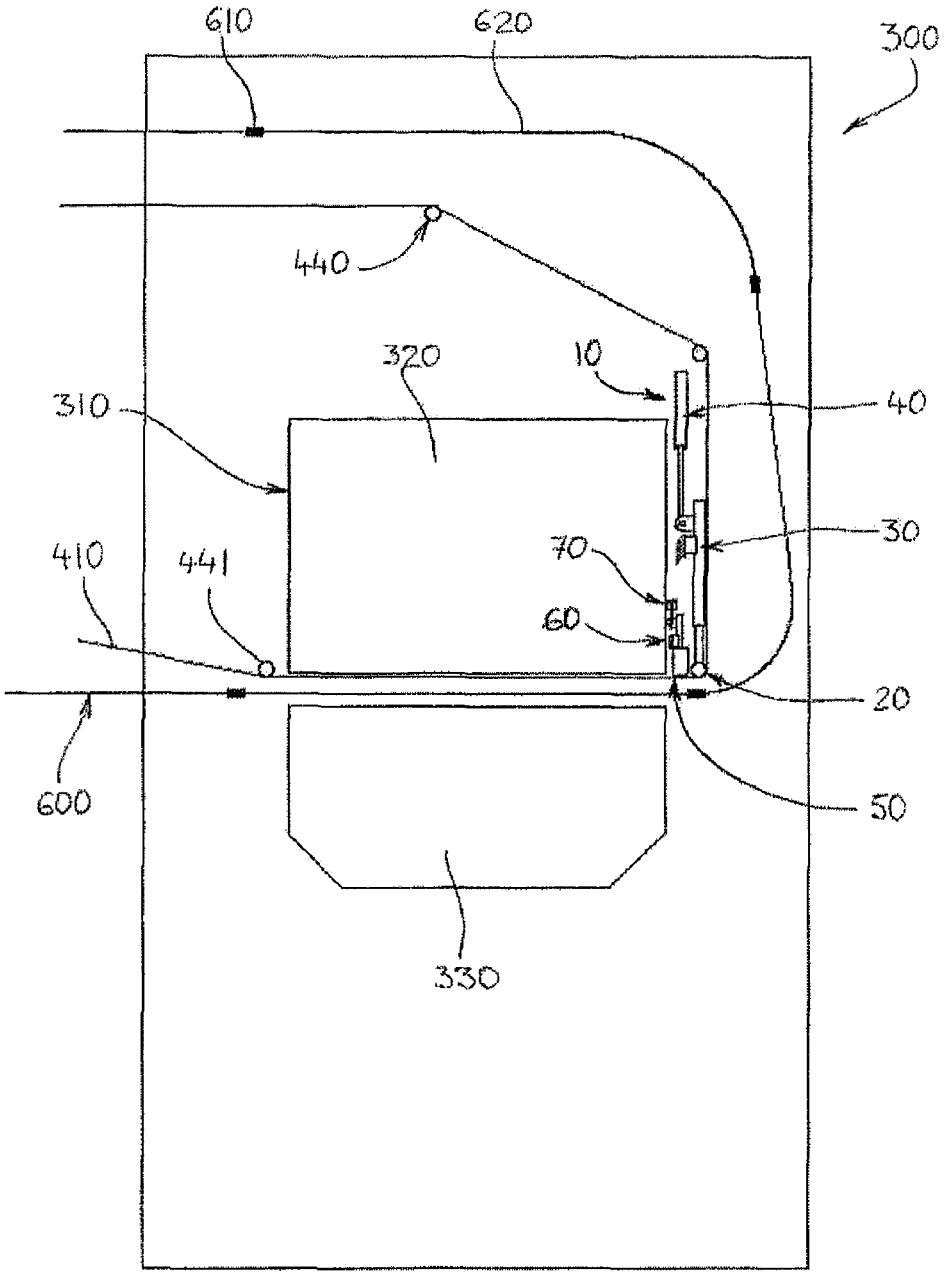
FIG. 2 schematically shows in detail the stamping station of the printing machine.

As seen in FIG. 2, the stamping station 300 has a device 10 for guiding the stamping foil 410 as it enters the platen press 310. The guiding device 10 comprises a movable diverting member 20 mounted to move between a work position, FIG. 3 in which the diverting member 20 directs the stamping foil 410 into the platen press 310 in a given feed plane known as the operational plane, and a maintenance position, FIG. 4 in which the diverting member 20 is positioned in a space accessible to a user.

Figures 3, 4, 5:
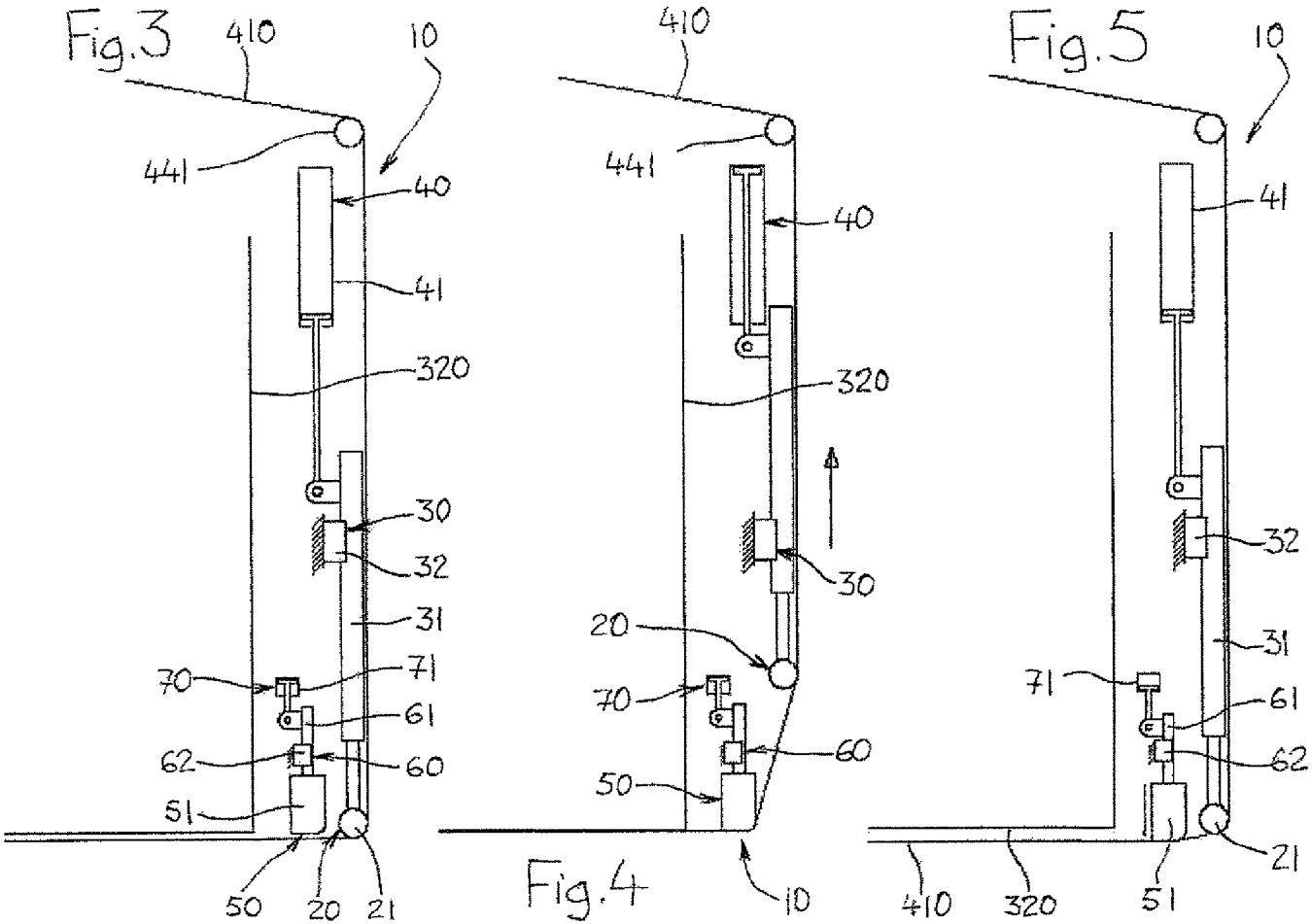
FIG. 3 schematically shows the foil guiding device in the work position.
FIG. 4 schematically shows the guiding device in the maintenance position.
FIG. 5 illustrates the guiding device in a maintenance position for allowing intervention on the platen press.

As seen in FIG. 4, in its maintenance position, the diverting member 20 is spaced some distance from the operational plane that each stamping foil 410 is intended to follow inside the platen press 310.

Advantageously, the guiding device 10 includes a first guide device 30 configured and operable to guide movement of the diverting member 20 between the work and maintenance positions.

In this embodiment, the first guide device 30 comprises a support 31 secured to the diverting member 20. The support is mounted to slide with respect to a guide rail 32. However, any other known guide means could be used which achieves equivalent movement.

The guiding device 10 is also provided with a first drive device 40 configured and operable to drive movement of the diverting member 20 between the work and maintenance positions.

In this embodiment, the first drive device 40 comprises a pneumatic actuator 41 which directly causes the support 31 to slide along the guide rail 32. However, again, any other known drive could be used in an equivalent way, for example, a combination of a number of pneumatic actuators, one or more hydraulic actuators, or a linear electric motor.

In a preferred embodiment, the diverting member 20 is mounted with translational mobility in a direction substantially orthogonal to the operational plane, in which the stamping foil 410 is to be fed when the platen press 310 is operating.

But, the translational movement may be in any trajectory, that is a purely rectilinear or circular trajectory, or more generally a curvilinear trajectory or may result from any combination of these movements whatsoever.

In material terms, the diverting member 20 comprises an air-powered diverting member 21 of elongate shape, which is mounted with transverse translational mobility between the work and maintenance positions.

The air-powered diverting member 21 is conventional because it has the form of a tube of circular cross section through which compressed air flows, and having a wall in which a plurality of orifices are pierced. The purpose of these orifices is to allow compressed air to escape. The air film thus created between the tube and the foil 410 limits the friction forces and therefore encourages slippage.

Like any air-powered diverting member of the prior art, the diverting member 20 is able to support one or more guide clips capable of laterally guiding the feeding of each stamping foil.

FIG. 3 shows that the operational plane extends as close as possible to the upper platen 320 of the press 310 so that the stamping foil 410 can be fed flush with the stamping tools mounted under the upper platen 320. The tools in question need to be changed each time a new print job is to be performed. For this operation to be able to be performed with ease, the guiding device 10 has a maintenance position that allows the stamping foil 310 to be moved temporarily away from the upper platen 320 and therefore from the operational feed plane as shown in FIG. 5.

To do that, according to another specific feature of the invention, the guiding device 10 has a holding member 50 which is mounted with the ability to move. It moves between a passive position in which the holding member 50 has no direct effect on the arrangement of the stamping foil 410 inside the platen press 310, as in FIGS. 3 and 4, and an active position in which it holds the stamping foil 410 some distance away from the operational plane, as in FIG. 5.

There are therefore various results that may arise according to the actual position of the diverting member 20.

As seen in FIG. 3, when the diverting member 20 is in the work position, the guiding device 10 is so arranged that, in the passive position, the holding member 50 is kept away from the stamping foil 410. The stamping foil 410 therefore extends precisely in the operational plane.

By contrast, when the diverting member 20 is in the maintenance position, there are two conceivable solutions according to whether the holding member 50 is in the passive position or in the active position.

Hence then, if the holding member 50 is in the passive position according to FIG. 4, the assembly is preferably arranged in such a way that the holding member 50 is able to hold each stamping foil 410 substantially in the operational plane.

On the other hand, when the holding member 50 is in the active position, the assembly is advantageously arranged such that the holding member 50 is able to hold each stamping foil 410 some distance away from the operational plane, which configuration has not been depicted.

FIGS. 3 to 5 also clearly show that the holding member 50 is installed between the diverting member 20 and the platen press 310.

In a particularly advantageous way, the guiding device 10 is provided with a second guide device 60 able to guide the movement of the holding member 50 between the passive and active positions.

In a similar way to the diverting member 20, in this embodiment, the second guide device 60 comprises a support 61 which is secured to the holding member 50, and which is mounted to slide with respect to a guide rail 62. However, any other known guide means could be used in an equivalent way.

According to another advantageous feature of the invention, the guiding device 10 is also provided with a second drive device 70 able to guide the movement of the holding member 50 between the passive and active positions.

In the exemplary embodiment of FIGS. 1 to 5, the second drive device 70 comprises a pneumatic actuator 71 which directly actuates the support 61 along the guide rail 62. However, any other known drive device could be used in an equivalent way. These include a combination of several pneumatic actuators, one or more hydraulic actuators, or a linear electric motor.

According to one currently preferred embodiment of the invention the holding member 50 is mounted with translational mobility in a direction substantially orthogonal to the operational plane, through which the stamping foil 410 is fed inside the platen press 310.

The translational movement may be along any trajectory, that is purely rectilinear or circular, or curvilinear, or the result of any combination of these movements.

In this embodiment, the holding member 50 comprises a bar 51 which is mounted with transverse translational mobility between the passive and active positions.

FIGS. 3 to 5 specifically show that the bar 51 is of rectangular cross section, so as to offer satisfactory rigidity. Moreover, because the stamping foil 410 is intended to come into contact with two directly adjacent faces of the bar 51, the assembly is arranged such that those faces are connected by a rounded surface at a corner edge. This feature protects the stamping foil 410 to not be damaged.

The invention relates more generally to any stamping station 300, as in FIG. 2 comprising a platen press 310 and a guiding device 10 as previously described.

However, more generally still, the invention relates to any printing machine 1, as in FIG. 1 provided with such a stamping station 300.

The invention claimed is:

1. A guiding device for guiding movement of at least one stamping foil at an inlet to a platen press in which each foil is applied to a blank, the press having a platen at which the press applies the foil to a blank, wherein the guiding device comprises:

a diverting member which is mounted at a location prior to a diverting of the foil such that the diverting member is movable between a work position where the diverting member is inaccessible directly to the user of the platen press and in which the diverting member is located and configured to direct each stamping foil into the platen press in a selected feed or operational plane, and a maintenance position in which the diverting member is placed in a space such that the diverting member is directly accessible to a user of the press.

2. The guiding device according to claim 1, wherein the diverting member is positioned spaced a distance away from the operational plane when the diverting member is in the maintenance position.

3. The guiding device according to claim 1, comprising a first guide device located and configured to guide movement of the diverting member between the work position and the maintenance position.

4. The guiding device according to claim 1, further comprising a first drive device located and configured to drive the movement of the diverting member between the work position and the maintenance position.

5. The guiding device according to claim 1, wherein the diverting member is mounted with translational mobility in a direction substantially orthogonal to the operational plane.

6. The guiding device according to claim 1, wherein the diverting member comprises an air-powered diverting member of elongate shape, and the diverting member is mounted with transverse translational mobility between the work position and the maintenance position.

7. The guiding device according to claim 1, further comprising a holding member mounted and configured to move between a passive position in which the holding member has no direct effect on arrangement of each stamping foil inside the platen press and an active position in which the holding member is configured to hold each stamping foil a distance spaced away from the operational plane.

8. The guiding device according to claim 7, wherein when the diverting member is in the work position, the holding member in the passive position is spaced away from each stamping foil.

9. The guiding device according to claim 7, configured such that when the diverting member is in the maintenance position, the holding member in the passive position is configured to hold each stamping foil substantially in the operational plane.

10. The guiding device according to claim 7, wherein when the diverting member is in the maintenance position, the holding member in the active position is configured to hold each stamping foil away from the operational plane.

11. The guiding device according to claim 7, wherein the holding member is installed between the diverting member and the platen press.

12. The guiding device according to claim 7, further comprising a second guide located and configured to guide the movement of the holding member between the passive position and the active position.

13. The guiding device according to claim 7, further comprising a second drive located and configured to guide the movement of the holding member between the passive position and the active position thereof.

14. The guiding device according claim 7, wherein the holding member is mounted with translational mobility in a direction substantially orthogonal to the operational plane.

15. The guiding device according to claim 7, wherein the holding member comprises a bar which is mounted with transverse translational mobility between the passive position and the active position.

16. The guiding device according to claim 15, wherein the bar is of rectangular cross section, each stamping foil being guided to come into contact with the bar;

the bar having two directly adjacent faces, and the faces are connected by a rounded surface, and each foil is guided into contact with the adjacent faces of the bar.

17. A stamping station comprising the platen press and the guiding device according to claim 1.

18. A printing machine comprising a stamping station according to claim 17.

* * * * *